US011135701B2

(12) United States Patent
Spanner

(10) Patent No.: US 11,135,701 B2
(45) Date of Patent: Oct. 5, 2021

(54) HOOK TENSIONER

(71) Applicant: MAGNA STEYR Fahrzeugtechnik AG & Co KG, Graz (AT)

(72) Inventor: Gerhard Spanner, Ilz (AT)

(73) Assignee: MAGNA STEYR Fahrzeugtechnik AG & Co KG, Graz (AT)

( * ) Notice: Subject to any disclaimer, the term of this patent is extended or adjusted under 35 U.S.C. 154(b) by 283 days.

(21) Appl. No.: 16/262,624

(22) Filed: Jan. 30, 2019

(65) Prior Publication Data

US 2019/0291245 A1 Sep. 26, 2019

(30) Foreign Application Priority Data

Mar. 22, 2018 (EP) ..... 18163298

(51) Int. Cl.
*B25B 5/06* (2006.01)
*B25B 5/02* (2006.01)

(52) U.S. Cl.
CPC ..... *B25B 5/06* (2013.01); *B25B 5/02* (2013.01); *B25B 5/064* (2013.01)

(58) Field of Classification Search
CPC .... B25B 5/02; B25B 5/06; B25B 5/08; B25B 5/087; B25B 5/061; B25B 5/064; B25B 5/12; B25B 5/122; B23Q 3/06; B23Q 3/082
USPC ..... 269/239, 24, 25, 26, 27, 32, 228
See application file for complete search history.

(56) References Cited

U.S. PATENT DOCUMENTS 6,648,316 B1 * 11/2003 Vouland ..... B25B 5/12 269/24
2004/0041323 A1 * 3/2004 Migliori ..... B25B 5/16 269/32

FOREIGN PATENT DOCUMENTS

| | | | | |
|---|---|---|---|---|
| CN | 206296615 | * | 7/2017 | |
| CN | 206296615 | U | 7/2017 | |
| DE | 69903316 | T2 | 6/2003 | |
| DE | 202004019099 | U1 | 5/2005 | |
| DE | 202015008208 | U1 | 1/2016 | |
| EP | 1683606 | A1 | 7/2006 | |
| EP | 2626174 | A1 | 8/2013 | |
| EP | 3095558 | B1 * | 8/2017 | ..... B25B 5/16 |

OTHER PUBLICATIONS

CN206296615 Reference Machine Translation (Year: 2017).*
EP-3095558 Machine Translation (Year: 2017).*
Search Report from CNIPA (dated Jun. 24, 2020).

* cited by examiner

*Primary Examiner* — Lee D Wilson
*Assistant Examiner* — Alberto Saenz
(74) *Attorney, Agent, or Firm* — Jordan IP Law, LLC; Todd A. Vaughn

(57) ABSTRACT

A hook clamp that includes a clamping hook, an actuator, and a spring member configured to be received in an opening of a component which is to be clamped. The hook clamp requires only a small through-opening on the component which is to be clamped. The hook clamp is useable, for example, in instances of larger component tolerances, and facilitates a greater pulling force.

20 Claims, 5 Drawing Sheets

HOOK TENSIONER

CROSS-REFERENCE TO RELATED APPLICATIONS

The present application claims priority under 35 U.S.C. § 119 to European Patent Publication No. EP 18163298.5 (filed on Mar. 22, 2018), which is hereby incorporated by reference in its complete entirety.

TECHNICAL FIELD

Embodiments relate to a hook clamp comprising a clamping hook with a hook element, the clamping hook being configured to be received in an opening of a component which is to be clamped.

BACKGROUND

Hook clamps are already known per se, and are used particularly in the automobile industry. Hook clamps may be used, for example, to clamp a vehicle body component against another vehicle component in the course of vehicle production. The component which is to be clamped must have an opening in this case, through which a clamping hook, provided with a hook, of the hook clamp is guided so that via the hook the component may then be pulled in the direction towards the hook clamp ("rearwards") and in particular in the direction towards another component which is arranged between the component and a housing of the hook clamp.

The hook clamp may also be designed such that, during the pulling of the component which is to be clamped, the hook element is moved at the same time in a direction towards the hook ("downwards"). In that way, during the pulling movement the hook, the hook clamp may engage better in the component to be clamped and carry this along.

European Patent Publication EP 1 391 266 A2 discloses a centring clamp for the centred fixing of a component to be machined, comprising a centring pin which fits on an adapter plate and is arranged above a clamping hook, formed from a hook and hook arm, of the clamp drive, the centring pin having a through-slot for the clamping hook, wherein provision is made for protective elements, butting against the flanks of the clamping hook, for preventing entry of foreign objects into the tensioning-hook through-opening of the adapter plate. This known centring clamp has a centring pin which has to be guided through the component which is to be clamped, so the component requires a correspondingly large opening. Furthermore, the hook of the clamping hook in this embodiment is capable of relatively little movement in the transverse direction since its travel is limited by the centring pin. Therefore, the tool is less suited to larger component tolerances.

SUMMARY

Embodiments relate to an enhanced design for a hook clamp which is useable, for example, in instances of larger component tolerances, and which facilitates a greater pulling force. Such a hook clamp requires only a small through-opening on the component which is to be clamped.

In accordance with embodiments, a hook clamp may comprise: a clamping hook configured to be received in an opening of a component which is to be clamped, the clamping hook having a first clamping hook arm with a hook element formed on a free end thereof, and a second clamping hook arm arranged at an angle relative to the first clamping hook arm; an actuator pivotably on the second clamping hook arm at a pivot point to displace or otherwise move the clamping hook from an open position in a pulling direction into a closed position in which the hook element is displaced (in addition to the pulling direction) in a direction towards the hooking end of the hook element, i.e. in a hooking direction; and a spring element configured to pre-tension the clamping hook against the pulling direction at a pre-tensioning position between the pivot point and the hook element, wherein the clamping hook, at a guiding position between the pivot point and the hook element, is displaceably mounted in an elongated hole in a direction parallel to the pulling direction.

In accordance with embodiments, the hook clamp comprises a clamping hook having two clamping hook arms which are arranged at an angle relative to each other. For example, the two clamping hook arms may be arranged approximately at a right angle relative to each other.

In accordance with embodiments, the first clamping hook arm includes the hook element which is configured to perform the pulling.

In accordance with embodiments, the second clamping hook arm, especially, for example, at its free end, is configured to be pulled at a pivot point with via the actuator. The pulling at the pivot point, i.e., a movement in a rearward direction, is to bring about a pulling of the hook element, and thus, clamping of a component which is to be clamped. The second clamping hook arm may be arranged approximately at a right angle to the first clamping hook arm.

In accordance with embodiments, the clamping hook is additionally mounted between two ends thereof in an elongated hole so as to be moveable, which is limited by the elongated hole, in a longitudinal direction (i.e., in the pulling direction). This longitudinal direction, i.e., the direction of the elongated hole, may approximately correspond to a direction of the first clamping hook arm.

In accordance with embodiments, the spring element is configured to act on the clamping hook. The spring element may be arranged between the pivot point and the hook. The spring element may be arranged on the first clamping hook arm, especially at the end of the first clamping hook arm of the clamping hook, in order to push this against the pulling direction, i.e., in a forward direction. The spring element may especially be a compression spring. The spring element may comprise a simple compression spring which in the main is orientated parallel to the first clamping hook arm.

In accordance with embodiments, as a result of the design of the hook clamp, it achieves the effect that during a pulling on the pivot point via the actuator in an open position of the hook clamp, the clamping hook is pulled in a rearward direction. But in the process of movement, the hook clamp is initially pushed in a forward direction at the pre-tensioning position via the force of the spring element. In that way, the guiding position initially remains at a forward end of the elongated hole and the hook element initially executes a movement in a downward direction, i.e., in the hooking direction, and only with further pulling via force of the actuator in the pulling direction is the guiding position shifted rearwards inside the elongated hole and the hook element is therefore pulled rearwards in order to clamp (if necessary) a component which is grabbed by the hook.

In accordance with embodiments, the direction towards the hook clamp, i.e., the pulling direction, is referred to herein as the rearward direction. The direction in which the hook is moved towards its front end for engaging in a component, i.e., the hooking direction, is referred to herein as the downward direction, and is approximately normal/perpendicular to the pulling direction.

In accordance with embodiments, for unclamping, i.e., for opening the hook clamp via the actuator, a force may be applied in opposition to the pulling direction so that both the actuator force and the force of the spring element collectively push the clamping hook in the forward direction. If the guiding position of the hook element reaches the front end of the elongated hole in the process, and therefore, movement of the hook element is limited or terminated, the hook element, with further force application via the actuator on the pivot point, is moved upwardly again and the clamping hook is opened. The actuator may comprise an operating rod which is pivotably on the pivot point of the clamping hook, and is in the main, orientated parallel to the first clamping hook arm. The operating rod may also be formed via a multi-part component to include, for example, a spindle with fork heads at the ends for articulation. A force in the pulling direction may be applied to the operating rod via a pneumatic cylinder and/or via an electric motor and/or via a hand lever. The force of the pneumatic cylinder, of the hand lever or of the electric motor in the pulling direction, may be applied to the operating rod via a lever mechanism for force transmission.

In accordance with embodiments, using the hook clamp, only the clamping hook or the hook element is to be guided through an opening of the component which is to be clamped, so a small opening is sufficient for this task. In the case of this design, the hook element may cover a greater distance, and even in the event of more inaccurate positioning or design of the component which is to be clamped, may reliably grip this and pull it with high, almost constant pulling force.

In accordance with embodiments, the force of the actuator, in combination with the force of the spring element, in this case effects a pulling force in two directions, specifically in the pulling direction on the one hand and additionally in a direction which is normal thereto (i.e. downwardly) for closing the hook.

In accordance with embodiments, the guiding position and/or the pre-tensioning position may be arranged in a transition region between the first clamping hook arm and the second clamping hook arm, i.e., in proximity to that end of the second clamping hook arm which merges into the first clamping hook arm, or in proximity to that end of the first clamping hook arm which merges into the second clamping hook arm.

In accordance with embodiments, a guide pin which is displaceably mounted in the elongated hole of a guide housing in a direction parallel to the pulling direction, may be arranged on the clamping hook at the guiding position between the pivot point and the hook element.

DRAWINGS

Embodiments will be illustrated by way of example in the drawings and explained in the description below.

DESCRIPTION

Figure 1:
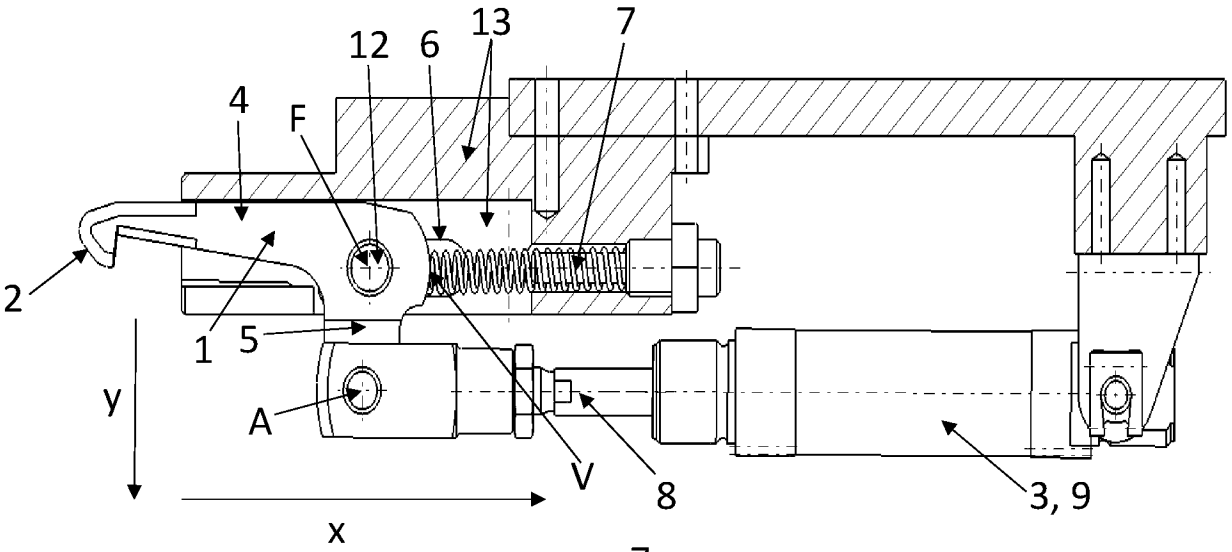
FIG. 1 illustrates a sectional side view of a hook clamp in an open position, in accordance with embodiments.
Figure 2:
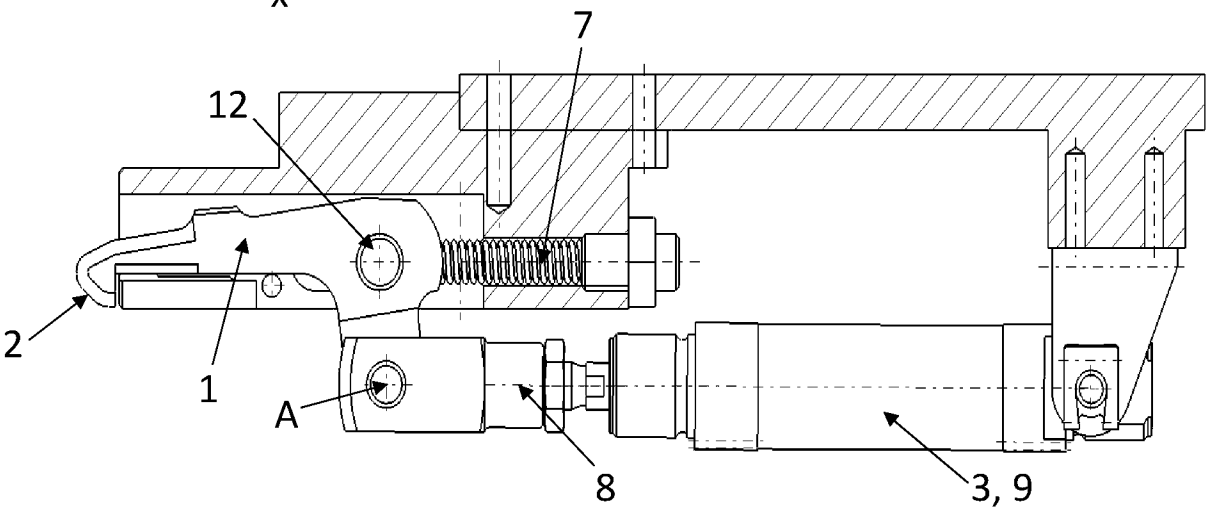
FIG. 2 illustrates a sectional side view of the hook clamp of FIG. 1 in a closed position.
Figure 3:
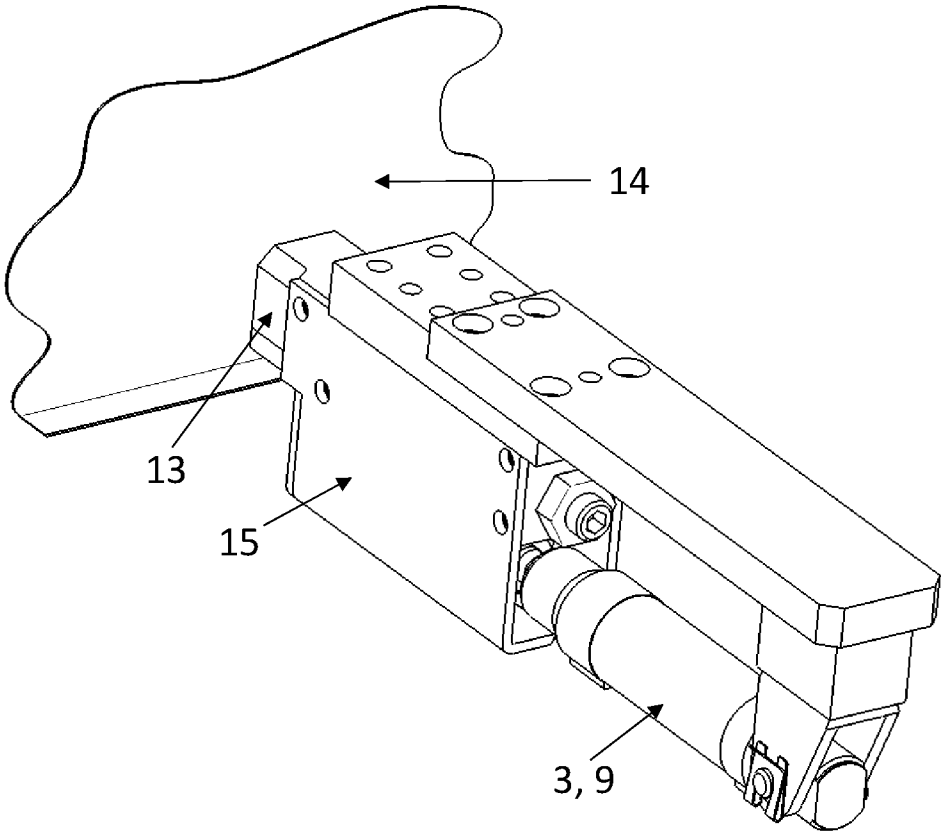
FIG. 3 illustrates a perspective view of the hook clamp of FIG. 1, with a component which is to be clamped.

FIGS. 1 to 3 illustrate a hook clamp in a first example, with FIG. 1, illustrating the hook clamp in an open position, FIG. 2 illustrating the hook clamp in a closed position, and FIG. 3 illustrating the hook clamp in an inserted position into a component 14 which is to be clamped.

As illustrated in FIGS. 1 to 3, in accordance with embodiments, the hook clamp comprises a clamping hook 1 having a hook element 2. The clamping hook 1, via the hook element 2, is configured to be received in an opening of a component 14 which is to be clamped. The hook clamp also comprises an actuator 3, such as, for example, an operating rod 8 and a pneumatic cylinder 9, to facilitate movement of the clamping hook 1 in a pulling direction x from the open position into the closed position. In the closed position, the hook element 2, in addition to displacement in the pulling direction x, is also displaced in a hooking direction y toward the end of the hook element 2.

In accordance with embodiments, the pulling direction x is a rearward movement whereas the hooking direction y is a downward movement that is approximately perpendicular to the pulling direction x.

The clamping hook 1 comprises a first clamping hook arm 4 and a second clamping hook arm 5 which is approximately at a right angle to the first clamping hook arm 4. The hook element 2 is formed on a free end of the first clamping hook arm 4. The actuator 3 is to move the clamping hook 1 into the closed position. The actuator 3 is connected via a hinge connection to the second clamping hook arm 5 at a pivot point A located, for example, on the free end of the second clamping hook arm 5.

At a guiding position F which is located between the pivot point A and the hook element 2, the clamping hook 1 may be displaceably mounted in an elongated hole 6 in a direction parallel to the pulling direction x. For this purpose, the clamping hook 1 has a guide pin 12 arranged at the guiding position F. The elongated hole 6 is formed in a guide housing 13 of the hook clamp. The actuator 3 may be fastened to the guide housing 13.

As illustrated in FIG. 3, the clamping hook 1 together with the guide housing 13 may be enclosed by a casing 15.

In accordance with embodiments, the clamping hook 1 is pre-tensioned against the pulling direction x via a bias mechanism such as, for example, a spring element 7, at a pre-tensioning position V between the pivot point A and the hook element 2. The spring element 7 may comprise a compression spring which in the main is orientated parallel to the first clamping hook arm 4.

In accordance with embodiments, the actuator 3 may comprise a multi-component design that includes operating rod 8 orientated parallel to the first clamping hook arm 4, and a pneumatic cylinder 9. The operating rod 8 is configured to transmit a force to the pivot point A of the clamping hook 1. The clamping hook 1 may be installed in the guide housing 13, with guide pin inserted, clamps and positions components due to a pulling movement.

The hook clamp operates in such a way that in the open position (e.g., FIG. 1), with a pulling movement via the pneumatic cylinder 9 or via a manually driven hand lever 10 (e.g., FIG. 8), a clamping hook 1 which is guided in an elongated hole 6 and guide housing 13 may be initially pulled with a partial force downwards in the hooking direction y. This initial movement of the clamping hook 1 is ensured via the return spring 7. The clamping hook 1 then comes up against a stop element (not illustrated), which may be attached at the bottom and may form part of the guide housing 13, and on account of the pulling movement subsequently moves rearwardly in the pulling direction x toward the contact surface of a component which is to be clamped. The clamping force of the clamping hook 1 to a rearward direction towards the contact surface is dependent on the force transmitted by the pneumatic cylinder 9, and also on the opposing force of the return spring 7. The partial force of the clamping hook 1 downwards towards the stop element is dependent on the respective lengths of the first clamping hook arm 4 and second clamping hook arm 5 and also on the opposing force of the return spring 7.

When the hook clamp is in an open position, the clamping hook 1 is pushed forwardly against the pulling direction x, via the pneumatic cylinder 9 or the hand lever 10, assisted by the spring element 7. The guide pin 12 of the clamping hook 1 then reaches the end of the elongated hole 6 which is provided for the guide pin 12, and is subsequently pushed upwardly as far as a stop on the clamping hook 1, and thus, reaches the open position again.

Figure 5:
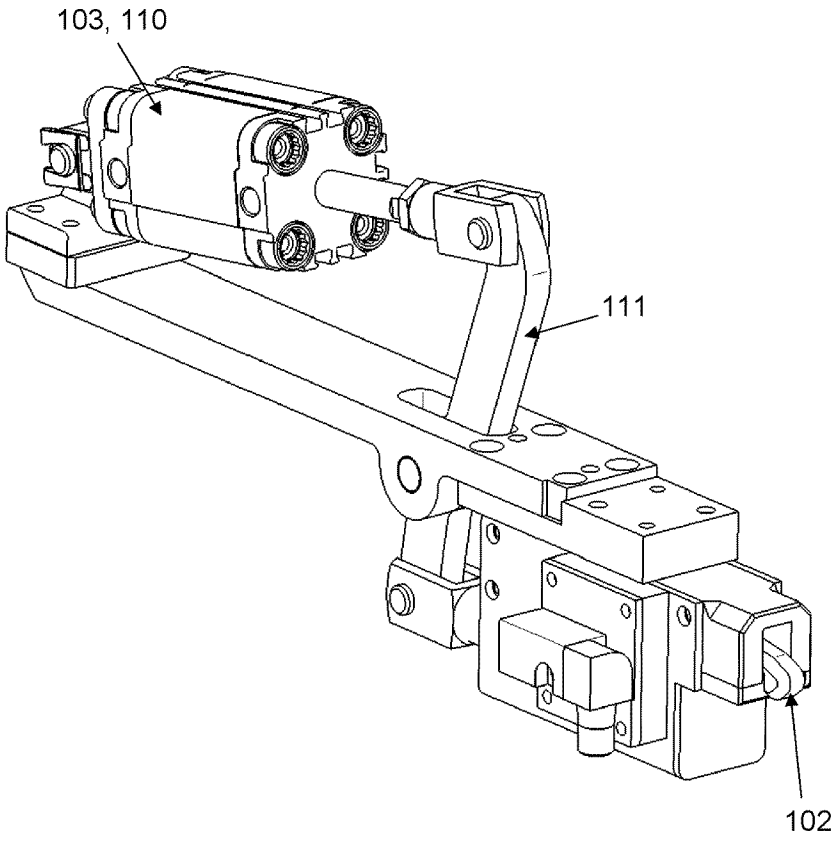
FIG. 5 illustrates a perspective view of the hook clamp of FIG. 4 in a closed position.
Figure 4:
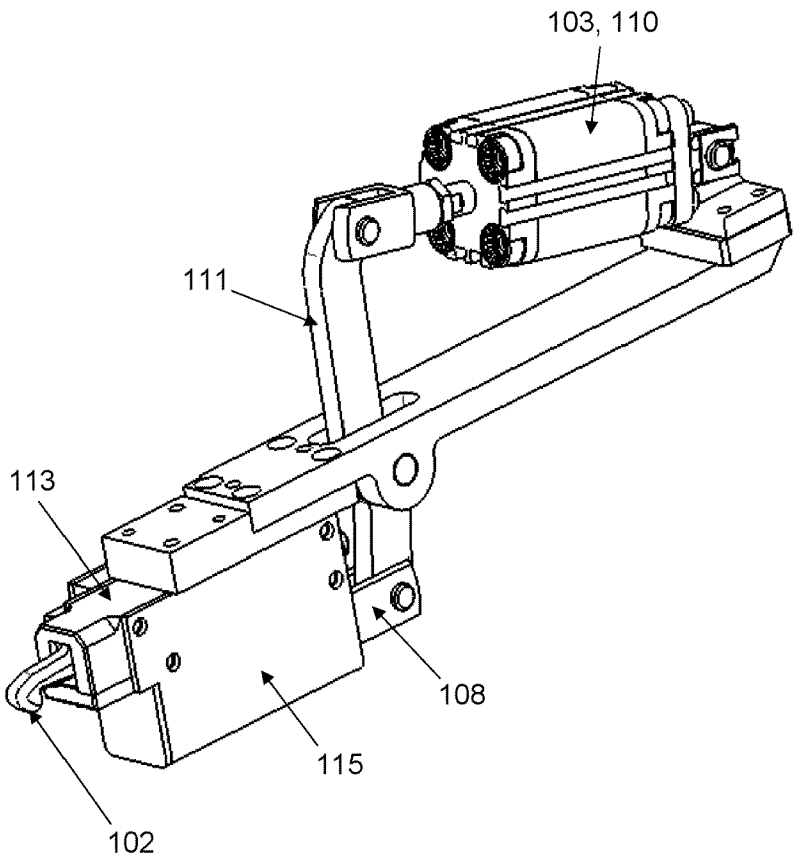
FIG. 4 illustrates a perspective view of a hook clamp in an open position, in accordance with embodiments.
Figures 6, 7:
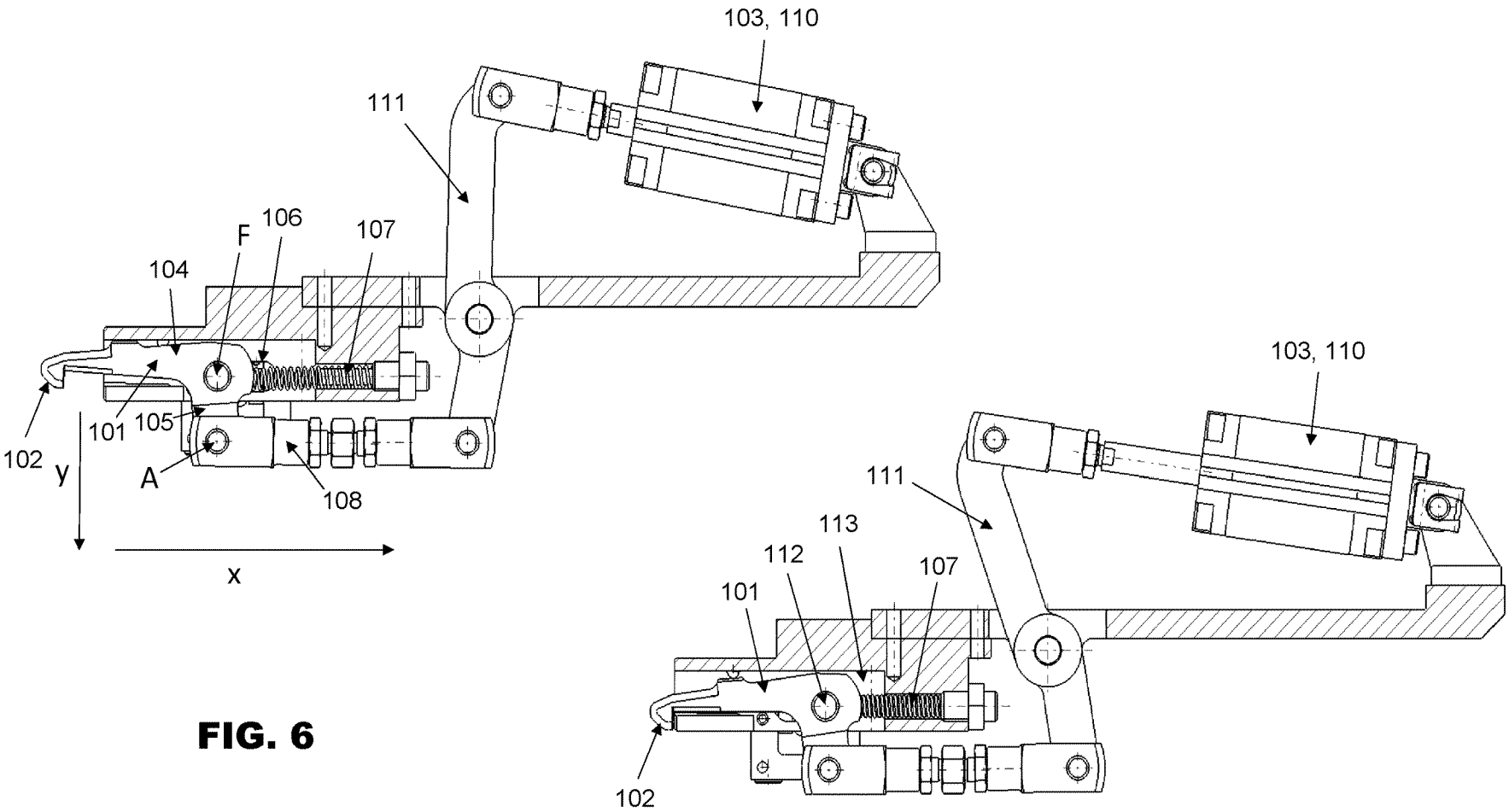
FIG. 6 illustrates a sectional side view of the hook clamp of FIG. 4 in the open position.
FIG. 7 illustrates a sectional side view of the hook clamp of FIG. 4 in the closed position.

FIGS. 4 to 7 illustrate a hook clamp in a second example, with FIGS. 4 and 6 illustrating the hook clamp in an open position, and FIGS. 5 and 7 illustrating the hook clamp in a closed position.

As illustrated in FIG. 4, a hook clamp includes an actuator 103 may comprise an operating rod 108, a pneumatic cylinder 109, and an electric motor 110. The electric motor 110, however, is not arranged on the same side of the guide housing 113 as in the first example illustrated in FIGS. 1 to 4. Instead, the electric motor 109 is arranged on a side of the guide housing 113 which lies opposite to the clamping hook 101. The force transmitted by the electric motor 109 is applied to the operating rod 108 via a lever mechanism 111. The lever mechanism 111 comprises a lever which is guided through an opening in the guide housing 113.

Figures 8, 9, 10:
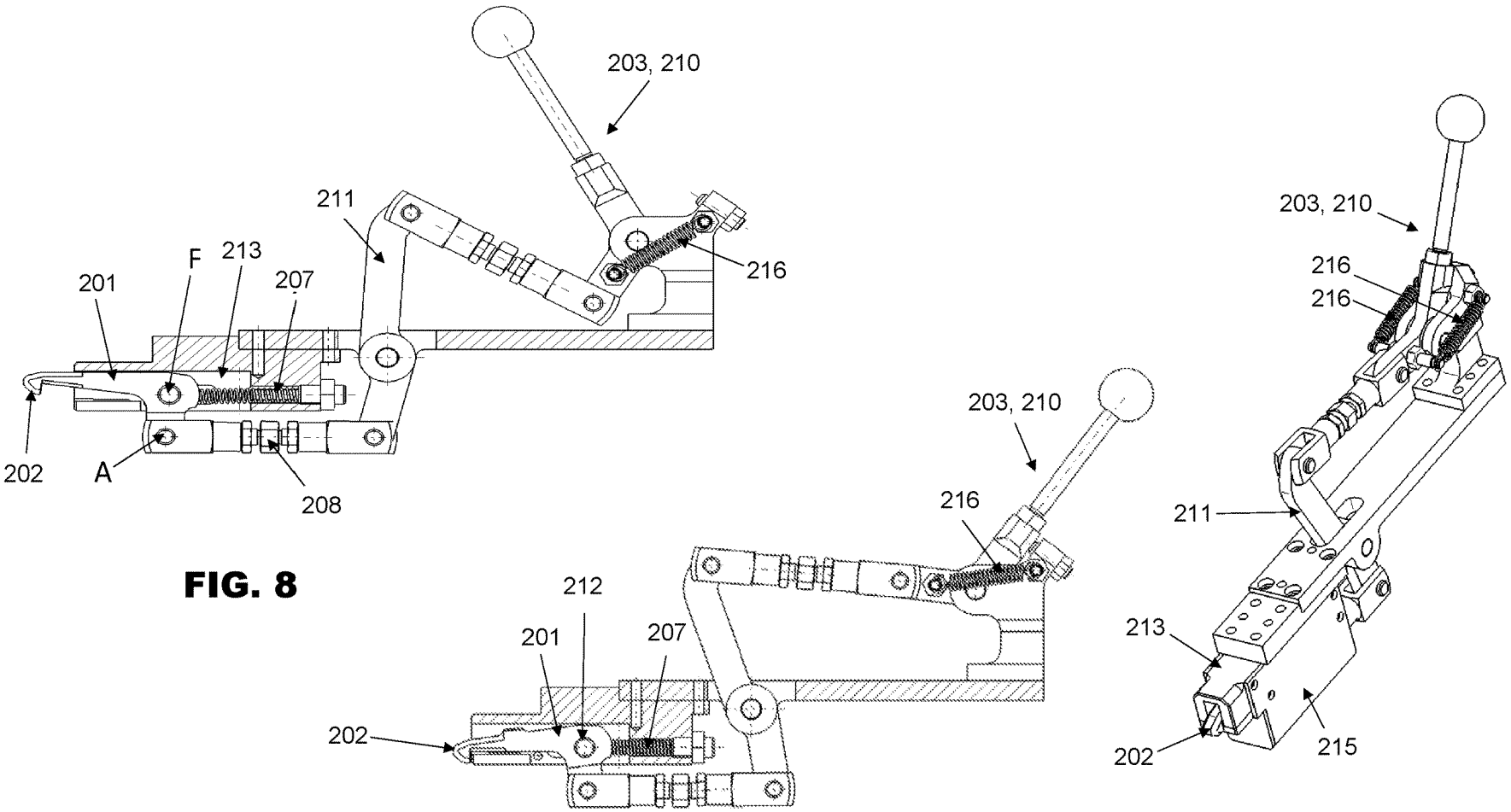
FIG. 8 illustrates a sectional side view of a hook clamp in an open position, in accordance with embodiments.
FIG. 9 illustrates a sectional side view of the hook clamp of FIG. 8 in a closed position.
FIG. 10 illustrates a perspective view of the hook clamp of FIG. 8 in the closed position.

FIGS. 8 to 10 illustrate a hook clamp in a third example, with FIG. 8 illustrating the hook clamp in an open position, and FIGS. 9 and 10 illustrating the hook clamp in a closed position.

As illustrated in FIG. 8, a hand lever 210 is used as the actuator 203 and again uses a lever mechanism 211 for force application upon the clamping hook 201. The lever mechanism 211 is guided through the guide housing 213. The actuation via a manually operable hand lever 210 for applying a force in the pulling direction x may be assisted, for example, by force assisting elements, such as one or more springs 216.

The terms "coupled," "attached," or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

LIST OF REFERENCE SYMBOLS

1, 101, 201 Clamping hook
2, 202, 302 Hook element
3, 103, 203 Actuator
4, 104, First clamping hook arm
5, 105 Second clamping hook arm
6, 106 Elongated hole
7, 107, 207 $1^{st}$ Spring element
8, 108, 208 Operating rod
9, 109, 209 Pneumatic cylinder
110 Electric motor
111, 211 Lever mechanism
12, 112, 212 Guide pin
13, 113, 213 Guide housing
14 Component to be clamped
15, 115, 215 Housing casing
210 Hand lever
216 $2^{nd}$ and $3^{rd}$ Spring elements
x Pulling direction
y Hooking direction
A Hinge point
F Guiding position
V Pre-tensioning position

What is claimed is:

1. A hook clamp, comprising:

a guide housing defining an elongated hole;

a clamping hook displaceably mounted for rotation in the elongated hole at a guiding position and configured to be guided in an opening of a component which is to be clamped, the clamping hook having a first clamping hook arm with a hook member formed on a free end thereof, and a second clamping hook arm arranged at an angle relative to the first clamping hook arm;

an actuator, having an operating rod pivotably connected to the second clamping hook arm at a pivot point to rotate the clamping hook from an open position into a closed position by a pulling movement in a first direction that is parallel to the longitudinal axis of the first clamping hook arm and also in a second direction that is perpendicular to the longitudinal axis of the first clamping hook arm, wherein the elongated hole of the guide housing extends in a direction parallel to the first direction and the guiding position is located between the pivot point and the hook member; and a spring member, oriented parallel to the actuator, configured to pre-tension the clamping hook against the first direction at a pre-tensioning position between the pivot point and the hook member.

2. The hook clamp of claim 1, wherein the first direction comprises a pulling direction that is in a direction towards the elongated hole of the guide housing.

3. The hook clamp of claim 1, wherein the second direction comprises a hooking direction that is in a direction towards a hooking end of the clamping hook.

4. The hook clamp of claim 1, wherein the guiding position and/or the pre-tensioning position are arranged in a transition region between the first clamping hook arm and the second clamping hook arm.

5. The hook clamp of claim 1, wherein the spring member comprises a compression spring which is orientated in a direction parallel to the longitudinal axis of the first clamping hook arm.

6. The hook clamp of claim 1, wherein the actuator comprises:

a pneumatic cylinder configured to transmit a force to the operating rod in a manner which moves the clamping hook to the closed position.

7. The hook clamp of claim 1, further comprising:

a guide pin displaceably mounted in the elongated hole and operatively connected to the clamping hook at the guiding position, wherein the clamping hook is displaceably mounted in the elongated hole in a direction parallel to the first direction.

8. The hook clamp of claim 1, wherein the second clamping hook arm is arranged approximately at a right angle to the first clamping hook arm.

9. A hook clamp, comprising:

a guide housing defining an elongated hole;

a clamping hook displaceably mounted in the elongated hole at a guiding position and configured to be received in an opening of a component which is to be clamped, the clamping hook having a first clamping hook arm with a hook member formed on a free end thereof, and a second clamping hook arm arranged at an angle relative to the first clamping hook arm;

an actuator configured to move the clamping hook from an open position into a closed position by a pulling movement in a first direction that is parallel to a longitudinal axis of the first clamping hook arm and also in a second direction that is perpendicular to the longitudinal axis of the first clamping hook arm, wherein the elongated hole of the guide housing extends in a direction parallel to the first direction, the actuator assembly including:

an operating rod which is pivotably connected to the second clamping hook arm at a pivot point to rotate the clamping hook from the open position into the closed position by the pulling movement, the operating rod being orientated in a direction parallel to the longitudinal axis of the first clamping hook arm, wherein the guiding position is located between the pivot point and the hook member;

a lever member configured to transmit a force to the operating rod in a manner which moves the clamping hook to the closed position; and an electric motor to drive the lever member; and a spring member, oriented parallel to the actuator, configured to pre-tension the clamping hook against the first direction at a pre-tensioning position between the pivot point and the hook member.

10. The hook clamp of claim 9, wherein the first direction comprises a pulling direction that is in a direction towards the elongated hole.

11. The hook clamp of claim 9, wherein the second direction comprises a hooking direction that is in a direction towards a hooking end of the hook member.

12. The hook clamp of claim 9, wherein the guiding position and/or the pre-tensioning position are arranged in a transition region between the first clamping hook arm and the second clamping hook arm.

13. The hook clamp of claim 9, wherein the spring member comprises a compression spring which is orientated in a direction parallel to the longitudinal axis of the first clamping hook arm.

14. The hook clamp of claim 9, further comprising:

a guide pin displaceably mounted in the elongated hole and operatively connected to the clamping hook at the guiding position, wherein the clamping hook is displaceably mounted in the elongated hole in a direction parallel to the first direction.

15. A hook clamp, comprising:

a guide housing defining an elongated hole;

a clamping hook displaceably mounted in the elongated hole at a guiding position and configured to be received in an opening of a component which is to be clamped, the clamping hook having a first clamping hook arm with a hook member formed on a free end thereof, and a second clamping hook arm arranged at an angle relative to the first clamping hook arm;

an actuator configured to move the clamping hook from an open position into a closed position by a pulling movement in a first direction that is parallel to a longitudinal axis of the first clamping hook arm and also in a second direction that is perpendicular to the longitudinal axis of the first clamping hook arm, wherein the elongated hole of the guide housing extends in a direction parallel to the first direction, the actuator including:

an operating rod which is pivotably connected to the second clamping hook arm at a pivot point to rotate the clamping hook from the open position into the closed position by the pulling movement, the operating rod being orientated in a direction parallel to the longitudinal axis of the first clamping hook arm, wherein the guiding position is located between the pivot point and the hook member;

a lever member configured to transmit a force to the operating rod in a manner which moves the clamping hook to the closed position; and a manually operable hand lever to drive the lever mechanism; and a spring member, oriented parallel to the actuator, configured to pre-tension the clamping hook against the first direction at a pre-tensioning position between the pivot point and the hook member.

16. The hook clamp of claim 15, wherein the first direction comprising a pulling direction that is in a direction towards the elongated hole.

17. The hook clamp of claim 15, wherein the second direction comprising a hooking direction that is in a direction towards a hooking end of the hook member.

18. The hook clamp of claim 15, wherein the guiding position and/or the pre-tensioning position are arranged in a transition region between the first clamping hook arm and the second clamping hook arm.

19. The hook clamp of claim 15, wherein the spring member comprises a compression spring which is orientated in a direction parallel to the longitudinal axis of the first clamping hook arm.

20. The hook clamp of claim 15, further comprising:

a guide pin displaceably mounted in the elongated hole and operatively connected to the clamping hook at a guiding position located between a pivot point and the hook member, wherein the clamping hook is displaceably mounted in the elongated hole in a direction parallel to the first direction.

* * * * *